United States Patent [19]

Renaut

[11] 4,117,699

[45] Oct. 3, 1978

[54] CALENDERS FOR THE THERMAL TREATMENT OF LAMINAR MATERIAL

[75] Inventor: Henry Renaut, Roubaix France

[73] Assignee: Lemaire & Cie, France

[21] Appl. No.: 744,262

[22] Filed: Nov. 23, 1976

[30] Foreign Application Priority Data

Feb. 19, 1976 [FR] France ..... 76 05168

[51] Int. Cl.[2] ..... B41F 3/52; B65H 5/02

[52] U.S. Cl. ..... 68/5 D; 8/2.5 A; 34/118; 198/626; 198/813; 101/470; 271/272; 271/275; 34/116;118;155;160

[58] Field of Search ..... 8/2.5 A; 68/5 C; 101/470; 271/272, 275; 198/626, 813

[56] References Cited

U.S. PATENT DOCUMENTS

| | | | |
|---|---|---|---|
| 876,007 | 1/1908 | Moss | 34/118 |
| 1,748,136 | 2/1930 | Lipsius | 34/155 |
| 2,585,834 | 2/1952 | Pocock | 271/275 |
| 2,594,290 | 4/1952 | Chavannes | 101/171 |
| 2,895,395 | 7/1959 | Gern | 34/116 |
| 2,907,450 | 10/1959 | Reid | 198/813 |
| 3,151,953 | 10/1964 | Justus | 34/118 |
| 3,418,727 | 12/1968 | Morris | 198/813 |
| 3,689,350 | 9/1972 | Renaut | 156/540 |
| 3,788,106 | 1/1974 | True | 101/470 |

OTHER PUBLICATIONS

Transfer Printing -art or Science* by; Burtonshaw; International Dyer & Textile Printer; Mar. 19, 1971; pp. 335-340.

*Primary Examiner*—Clyde I. Coughenour

*Attorney, Agent, or Firm*—Robert E. Burns; Emmanuel J. Lobato; Bruce L. Adams

[57] ABSTRACT

A calender for the thermal treatment of laminar material utilizes a band of inert material carrying a design to be transferred to the laminar material. The calendar includes a cylindrical drum, and an endless belt or "messenger" is arranged to hug the surface of the drum so as to force the laminar material and the inert material against one another. Means are provided for driving the messenger in translatory movement along its length and/or for driving the drum about its axis. The messenger is constituted by a plurality of endless bands whose longitudinal edges are positioned side-by-side. A separate regulating means is provided to regulate the tension of each band.

2 Claims, 2 Drawing Figures

CALENDERS FOR THE THERMAL TREATMENT OF LAMINAR MATERIAL

BACKGROUND OF THE INVENTION

This invention relates to a calender for the thermal treatment of laminar material, and in particular to a calender intended for the thermo-printing of a pressure-sensitive textile material.

A thermo-printing process consists of bringing the material to be printed into contact, under pressure, with an inert support carrying a design which is to be transferred. This design is executed in dyes which can be vapourised or sublimated. The whole assembly is then brought to a temperature suitable for causing evaporation or sublimation of the dyes and for making them pass to the material to be printed, during a time which is determined as a function of the intensity of the shade to be obtained. The treatment temperature is generally of the order of 220° C and the contact duration of the order of 20 seconds tp 5 minutes.

This treatment, when it is carried out continuously on materials of great length, is put into effect in a calender constituted by a heated cylindrical drum which is rotatable about its axis and against which the material to be printed and the inert support for the design to be transferred, now offered up in the form of a band, are applied one onto the other by an endless longitudinal belt or "messenger", the linear speed of which is equal to the circumferential speed of the heated drum, which it partially hugs around the cylindrical periphery.

Depending upon the nature of the fibres which make up the material to be thermo-printed and according to the nature of the dyes used, the belt and the "messenger" may be of different natures, in particular they may be impermeable or otherwise, and the calender may include various auxiliary devices for the purpose notably of facilitating thorough penetration of the dyes in a direction perpendicular to the general plane of the material printed, while at the same time avoiding diffusion along this plane, which would result in a blurred or inaccurate reproduction of the contours of the design.

None of the arrangements at present known give satisfaction, however, when it is desired to thermoprint textile materials which are sensitive to pressure, for example carpets, notably when these materials are of great length.

In fact, the quality of the thermo-printing obtained on such materials is very much influenced by the contact pressure of the inert support for the dyes and of the material to be thermo-printed and, even though it is possible to regulate this pressure to a certain extent by a greater or lesser tension of the messenger by means of a roll having a transverse axis applied onto one of its faces, no device at present known enables a uniform pressure to be obtained across the entire width of the belt or messenger, especially if this width is as large as, for example, 5 meters, as is the case when carpets are being printed.

In fact, differences in pressure of the order of 20 g per $cm^2$ are encountered between different zones distributed across the width of the messenger, these pressure differences being caused in particular by the distortions to which the messenger is inevitably subjected in its translatory movement along its own direction. Such differences in pressure in the direction of the width are not very harmful when, for example, woven fabrics are being treated, the required pressure then being generally of the order of 100 to 150 g per $cm^2$, but they have a very adverse effect when materials which require a low working pressure are being handled. For example, a pressure of the order of 5 to 50 g per $cm^2$ is required in the case of carpets, as carpets must be treated at a pressure which is both sufficient to ensure good penetration of the dyes in depth and to prevent their diffusion along the general plane of the carpet, and which at the same time is sufficiently low for the carpet, or more generally the material treated, not to adopt a crushed appearance. In the case of these low pressures, the differences of pressure recorded between the different zones of the messenger lead to noticeable differences in the appearance of the thermo-printed material.

The aim of the present invention is to overcome this disadvantage, and to achieve this result without modifying the nature of the messenger itself, that is to say in practice the nature of the materials of which the messenger is made and the way they are presented, which are generally dictated by the conditions of thermo-printing adapted notably to the fibres treated.

SUMMARY OF THE INVENTION

For this purpose, the calender according to this invention provides for the thermal treatment of products of small thickness, and notably for the thermo-printing of a textile material which is sensitive to pressure by means of a band of inert material carrying a design which is to be transferred. The calender comprises a cylindrical drum rotatably mounted about its axis, a longitudinal endless belt or "messenger" hugging a portion of the cylindrical periphery of the drum for the purpose of applying the material to be thermo-printed and said inert material one against the other, and means for driving the messenger in translatory movement along its length and/or for driving the drum rotatably about its axis. According to the invention the messenger is formed by transverse juxtaposition of a plurality of longitudinal endless bands, and it comprises separate adjustment means for adjusting the tension of each band.

DESCRIPTION OF THE DRAWINGS

One form of calender constructed in accordance with the invention will now be described, by way of example, with reference to the accompanying drawings, in which.

DESCRIPTION OF PREFERRED EMBODIMENT

Figure 1:
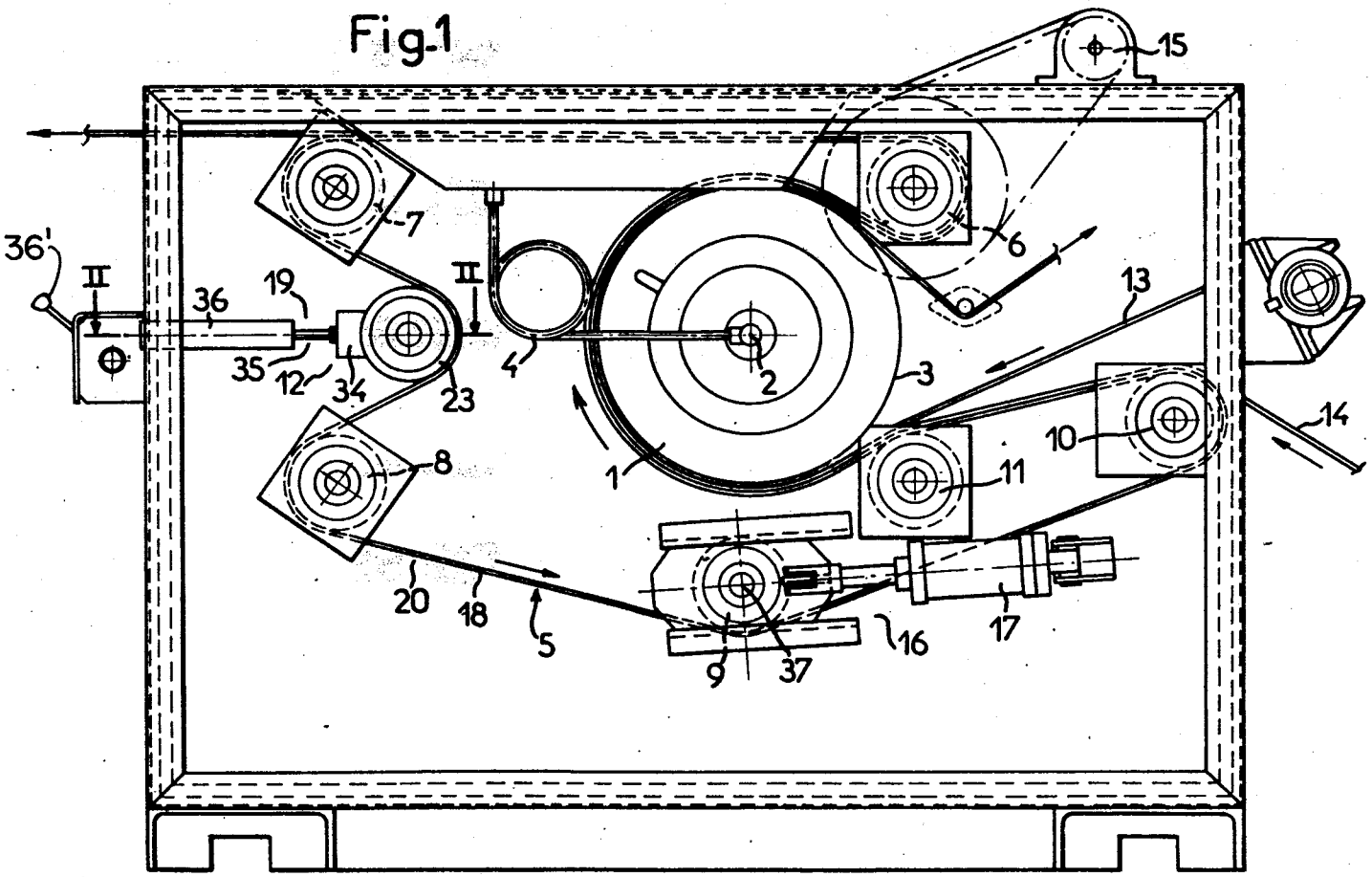
FIG. 1 is a side elevation of the calender from which its lateral walls have been removed in order to show the internal components.

Referring to the drawings, FIG. 1 shows a calender which includes a drum 1 having a cylindrical surface 3, and being rotatable about its axis 2. The drum 1 can idle about its axis 2 and can be mounted in the calender by any suitable device.

For carrying out a thermo-printing process, the calender comprises heating means, shown diagrammatically here by a duct 4, which supplies a heat transporting fluid to the inside of the drum 1, in a known manner.

The calender also includes a messenger 5, guided on a plurality of rollers 6 to 11 whose axes are generally parallel to the axis 2, and a tensioning device 12, which will be described later. The messenger 5 is arranged around a portion of the drum's cylindrical surface 3, and in practice around the greater part of this surface.

The function of the messenger 5 is to apply onto one another and onto the cylindrical surface 3 of the drum 1, an inert support belt or band 13, which carries the design to be transferred, and the sheet 14 of laminar textile material to be thermo-printed, both of which are in the form of longitudinal bands continuously supplied to the calender. The driving of the latter bands, and also the rotational driving of the drum 1 about its axis 2, is effected, via the messenger 5, by means of a motor-reduction unit 15 which rotationally drives the roller 6, the direction of movement of these various elements being indicated by arrows in FIG. 1.

A centering device 16 is provided for centering the messenger 5, the device 16 comprising a ram 17 which is mounted at one side of the calender and which is capable of causing the axis 37 of the roller 9 to adopt an orientation which is slightly oblique relative to a direction parallel to the axis 2 and to the axes of the other rollers, but in a plane which is still parallel to these axes. This compensates for any transverse movements of the messenger 5 which may occur.

Depending upon the thermo-printing process adopted, the surface 3 of the drum 1 and the messenger 5 may possess different permeability characteristics, and the calender may possess various accessory equipment, such as devices for sucking or blowing through the treated material 14 to influence the penetration of the dyes.

The material of which the messenger 5 is made may also be of any nature suitable to the treatment being carried out: for example, a messenger may be used which is made of a textile or metallic material resistant to temperatures of the order of 190° to 220° C, for example the tufted material sold commercially under the name of "Nomex".

The messenger 5 is not formed of a single band of material (as is the case with known calenders) but is formed by a plurality of longitudinal endless bands 18 which are positioned side-by-side. Each of these bands is provided with a separate adjustment device for adjusting its tension.

Figure 2:
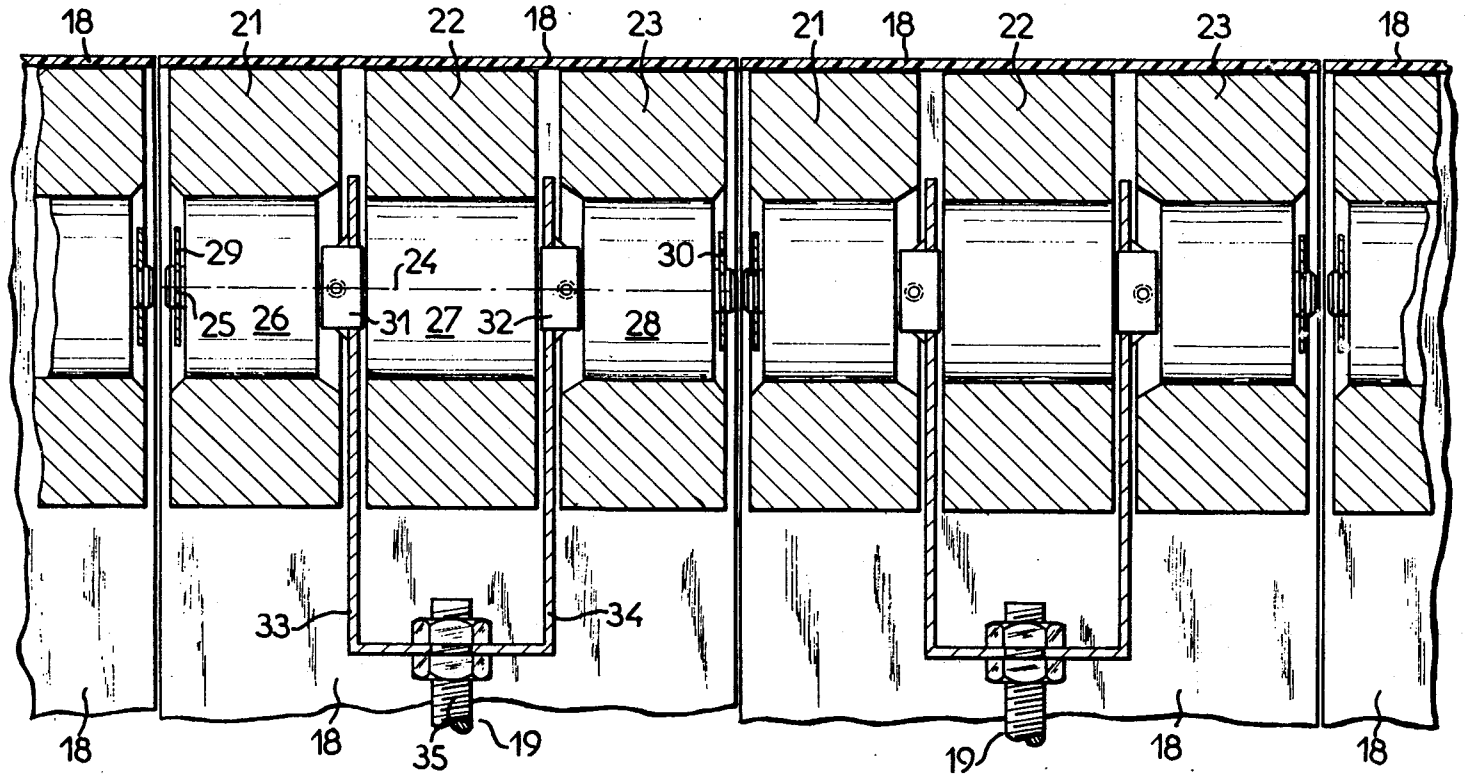
FIG. 2 is an enlarged partial cross-section taken on the line II—II of FIG. 1.

If reference is made to FIG. 2, it can be seen that the bands 18 forming the messenger 5 are positioned practically longitudinal edge to longitudinal edge along a direction parallel to the axis 2, and practically without any gaps. A small spacing can be accepted between two adjacent bands 18, for example a gap of the order of 5 mm is acceptable for a width of band of the order of 200 mm, these figures being given of course merely as an indication. Such a gap ensures that each band 18 is mechanically movable and adjustable in a way completely independent of its two neighbours, without the quality of the thermo-printing suffering, as the slight crushing to which the treated material 14 is subjected during its passage between the messenger and the cylindrical periphery of the drum ensures that all its fibres are subjected to the same treatment conditions.

The tensioning device 12 for the messenger 5 is accordingly constituted by a plurality of separate regulating devices 19, each of which enables the tension of one of the bands 18 to be regulated accurately. By this separate tension regulation for the individual bands, and their described, close proximity, side by side, the invention enables the pressure applied to the treated material 14 and to the inert support 13 to be rendered uniform in the direction of their widths, that is to say parallel to the axis 2, or again enables this pressure to be modulated in a predetermined manner along their widths.

Each of the illustrated, separate tensioning devices 19 acts between the two consecutive rollers 7 and 8, by thrusting against the face 20 of the band 18, particularly towards the surface 3 of the drum 1 in the zone where the material 14 to be thermo-printed and the support 13 are brought into contact. It is of course outside this contacting zone that the devices 19 act.

Each of these devices 19 is constituted of at least one cylindrical roller, rotatably mounted about an axis parallel to the axis 2 of the drum 1 and in contact around a portion of its peripheral surface with the face 20 of the associated band 18. In the example illustrated, each device 19 comprises three coaxial, cylindrical rollers 21 to 23, their axis 24 being parallel to the axis 2. The axis 24 is defined by a shaft 25, on which the three rollers 21 to 23 are rotatably mounted, for example, by means of ball-bearings or roller bearings, respectively 26 to 28. The rollers 21 to 23 are prevented from moving along the shaft 25 by appropriate stops, respectively 29 and 30, at the two ends of the shaft and 31 and 32 respectively between the rollers 21 and 22 and between the rollers 22 and 23. The three rollers 21 to 23 all have the same diameter and the same dimension along the axis 24.

The two stops 31 and 32 situated between the rollers 21, 22 and 22, 23 respectively are integral respectively with each of the arms 33 and 34 of a horizontal fork 33, 34 integral with a rod 35 of a ram 36 disposed horizontally and integrally attached to the frame of the calender (see FIG. 1). This combination of ram 36 and fork 33, 34 enables the same adjustable force, directed towards the face 20 of the corresponding band 18, to be applied to each roller 21, 22, 23.

The various rams 36, which carry the groups of rollers 21 to 23 corresponding to the different bands 18 of the messenger 5, are supplied separately with pressurised fluid in such a way as to apply to each band separately a thrust suitable for imparting to it the respective required tension. Since the value of the pressure inside each ram 36 corresponds to one value of the tension of the corresponding messenger band 18, adjustment can be carried out readily, at 36'. It will be understood that this can be done manually with a control obtained by reading a manometer which indicates the pressure of the fluid in the ram or, if applicable, which is graduated directly in terms of tension of the band of the messenger. It is also possible to provide automatic adjustment and control establishing the pressure of the fluid in each ram 36, that is to say the tension of each band 18, to a constant predetermined value.

It will be apparent that modifications could be made to the embodiment described above. In particular, the described method of tensioning the various bands 18 of the messenger 5 could well be changed.

We claim:

1. A calender for thermal treatment of laminar material to transfer a design from a band of inert material to the laminar material, the calender comprising:

a cylindrical, heatable drum rotatably mounted about an axis thereof;

an endless longitudinal belt and "messenger" which comprises a plurality of endless longitudinal bands with longitudinal edges thereof positioned side-by-side and which hugs the drum to force laminar material and a belt of inert material against one another;

means for driving the messenger in translatory movement along its length and for rotatably driving the drum about its axis;

separate regulating devices, each for regulating the tension of one of the bands, each regulating device comprising at least three rollers, rotatably mounted about a single axis parallel to the axis of the drum and disposed in contact, around a portion of the rollers' circumference, with one face of the corresponding band; and thrust means for applying to the rollers adjustable forces directed towards said face of the band, the thrust means comprising at least two arms fixed relative to the drum's axis at least in the direction of the adjustable force and disposed respectively between two of the rollers.

2. A calender for thermal transfer of a design from inert material to a sheet of laminar material, the calender comprising;

a cylindrical, heatable drum, mounted for rotation about an axis thereof;

an endless, longitudinal belt-like messenger which comprises a plurality of endless longitudinal bands with longitudinal edges thereof positioned side-by-side and which hugs the drum in such a way that in use, a sheet of laminar material such as a rug and a belt of inert material having a design thereon are thereby forced against one another for transferring the design from the belt to the sheet;

means for driving the messenger in a translatory, longitudinal movement, corresponding with the rotation of the drum; and separate regulating devices, each comprising means for separately regulating a tension of one of the bands of the messenger;

whereby the bands have mobile junctions therebetween, moving along with the bands and thereby with the laminar material and the belt of inert material;

each regulating device comprising (a) a roller disposed in contact, around a portion of the roller's circumference, with one face of the corresponding band, means for rotatably mounting the roller about an axis parallel to the axis of the drum and for regulating a distance of the roller from the drum, to effect the regulating of the tension of the band independently of the other bands, (b) thrust means for applying to the roller an adjustable force directed toward said face of the band to adjustably tension the band, and (c) additional rollers, mutually adjacent and coaxial, the thrust means comprising a fork having arms interposed between the mutually adjacent rollers, to apply the same adjustable force to each roller.

* * * * *